US011759967B2

(12) United States Patent
Wade

(10) Patent No.: US 11,759,967 B2
(45) Date of Patent: Sep. 19, 2023

(54) METHOD AND APPARATUS FOR PRODUCING SHEET MATERIAL ARTICLES FROM PLANIFORM BLANKS

(71) Applicant: Colin Maxwell Wade, Bury Saint Edmunds (GB)

(72) Inventor: Colin Maxwell Wade, Bury Saint Edmunds (GB)

(73) Assignee: Kongsberg Precision Cutting Systems Belgium BV, Ghent (BE)

( * ) Notice: Subject to any disclaimer, the term of this patent is extended or adjusted under 35 U.S.C. 154(b) by 144 days.

(21) Appl. No.: 16/971,422

(22) PCT Filed: Feb. 20, 2019

(86) PCT No.: PCT/IB2019/051388

§ 371 (c)(1),
(2) Date: Aug. 20, 2020

(87) PCT Pub. No.: WO2019/162857

PCT Pub. Date: Aug. 29, 2019

(65) Prior Publication Data

US 2021/0001504 A1 Jan. 7, 2021

(30) Foreign Application Priority Data

Feb. 20, 2018 (GB) ..... 1802742

(51) Int. Cl.
*B26D 7/01* (2006.01)
*B26F 1/38* (2006.01)

(52) U.S. Cl.
CPC ..... *B26D 7/018* (2013.01); *B26F 1/3813* (2013.01)

(58) Field of Classification Search
CPC .... B26D 7/018; B26D 7/1854; B26D 7/1818; B26D 7/1863; B26F 1/3813
See application file for complete search history.

(56) References Cited

U.S. PATENT DOCUMENTS 3,652,075 A * 3/1972 Thompson ..... B25B 11/005 269/21
5,341,558 A * 8/1994 Varidel ..... B26D 7/1818 29/469

(Continued)

FOREIGN PATENT DOCUMENTS

CA 2259785 C * 7/2008 ..... B26D 7/1818
DE 10300235 A1 * 7/2004 ..... B26D 7/1863

(Continued)

OTHER PUBLICATIONS

International Search Report and Written Opinion (Application No. PCT/IB2019/051388) dated May 29, 2019.

(Continued)

*Primary Examiner* — Jonathan G Riley
(74) *Attorney, Agent, or Firm* — Brown & Brown IP Law PLLC

(57) ABSTRACT

An automated sheet material cutting and handling system for producing sheet material articles having a planar shape comprises a cutting surface with a suction hold-down, a suction lifting apparatus, a robotic actuation system for moving the suction lifting apparatus, and a control system for controlling the operation of the cutting device and the suction lifting apparatus. The suction lifting apparatus comprises a suction lifting head including a suction lifting portion comprising a suction lifting plate for applying suction through a plurality of holes in the plate. The control system is configured to operate the cutting device to make at least one cut through the planiform blanks. A resiliently compressible template is adhered to the suction lifting plate. Also, methods.

16 Claims, 9 Drawing Sheets

(56) References Cited

U.S. PATENT DOCUMENTS

| | | | | | |
|---|---|---|---|---|---|
| 5,353,978 | A * | 10/1994 | Varidel | B26D 7/1818 | 225/97 |
| 5,695,600 | A * | 12/1997 | Goin | B25B 11/005 | 156/707 |
| 2001/0003936 | A1* | 6/2001 | Song | B26D 7/1863 | 83/25 |
| 2002/0088320 | A1* | 7/2002 | Marbach | B26D 7/1863 | 83/100 |
| 2003/0164620 | A1* | 9/2003 | Schmalz | B66C 1/0281 | 294/188 |
| 2012/0073417 | A1* | 3/2012 | Ujiie | B26D 7/018 | 83/13 |
| 2016/0067867 | A1* | 3/2016 | Harter | B25J 15/0691 | 294/188 |

FOREIGN PATENT DOCUMENTS

| | | | |
|---|---|---|---|
| EP | 0348311 | A1 * | 12/1989 |
| EP | 1 219 395 | A2 | 7/2002 |
| EP | 2 186 611 | A2 | 5/2010 |
| WO | 97/37523 | A2 | 10/1997 |
| WO | 2013/185834 | A1 | 12/2013 |

OTHER PUBLICATIONS

GB Search Report (Application No. GB1802742.5) dated Aug. 9, 2018.
https://esko.com/en/products/kongsberg-cutting-tables dated Feb. 11, 2020 (2 pages).
Translation of DE 10300235 downloaded from Espacenet Service.

* cited by examiner

METHOD AND APPARATUS FOR PRODUCING SHEET MATERIAL ARTICLES FROM PLANIFORM BLANKS

This patent application claims priority from United Kingdom Patent Application No. GB 1802742.5, dated 20 Feb. 2018, the entire contents of which are hereby incorporated by reference.

BACKGROUND a. Field of the Invention

The present invention relates to a method and apparatus for producing sheet material articles from planiform blanks, for example semi-rigid sheet plastic, sheet metal, paper-backed polyurethane open-cell or closed-cell foam board, plywood sheeting, solid cardboard, and corrugated cardboard and any other types of sheet materials which in a production environment may need to be cut and handled by machinery.

b. Related Art

There is often a need in a manufacturing operation to individually handle sheets of material, particularly those with sufficient strength to support their own weight. A process step may be used to modify the material, or the material may simply be moved. The sheet material may, for example, be cut, creased, folded, embossed, printed upon, transported or stacked. The sheet material may need to be placed on a cutting table, as part of the process. After cutting, cut material will be need to be moved off the table onto one or more stacks of cut planiform articles, by stacking one layer of sheet material on another. For convenience, any such location where planiform articles are to be placed on and/or lifted off by sheet material handling equipment is referred to herein as a "work station".

A specific example of a prior art work stations that may be used to cut or score fold lines in cardboard, are those supplied by Esko-Graphics bvba (see htLps://www.esko-.com/en/products/konosberg-cutting-tables). Cuts in sheet material are made by reciprocating vertical blade that is moved on a 2-axis Cartesian robotic actuator that moves over the work surface. Score lines can be formed in a similar manner by a scoring wheel mounted to the actuator. The cuts or fold lines for more than one such box may be made in a single sheet, depending on the size of the boxes being formed.

These work stations can be used with robotic sheet material handlers that comprise a machine vision system and a suction lifting apparatus comprising a suction lifting head that provides a downwardly oriented suction lifting portion that is substantially planar. Examples of downwardly oriented suction lifting portions include an array of individual, elastomeric suction cups, and a flat metallic plate, which is typically square or rectangular, perforated with an array of suction holes. The holes are connected to a source of vacuum (i.e. negative) air pressure for applying upwards suction through an array of holes in the plate.

The array of suction cups or suction holes may be a square or rectangular array along both horizontal (X− and Y−) directions. An actuation system then moves the array in at least one horizontal linear direction and in both directions along the vertical (Z−) direction. The actuation system may be a robotic arm with multiple degrees of freedom of movement and rotation at a manipulating end of the arm.

The array of suction cups or the suction lifting plate is then supported centrally at the manipulating end of the arm. Such an arm may lift and deposit sheet material within the reach of the arm anywhere on the cutting work station and adjacent stacking work stations, within the reach of the arm.

Other types of robotic sheet material handlers may alternatively be used, for example, a linearly movable gantry that spans the cutting and scoring work station, beneath which is supported the array of suction cups. This is a simpler and more economical way for lifting, moving and depositing sheet material, but is limited to drawing from or forming a stack along the line of travel of the gantry.

These production systems work well, but the stacked material after processing will usually need sorting or separating. An example of this is the cutting of sheets of corrugated cardboard, prior to forming into box containers, for example by folding and gluing operations. The initial sheet stock may have standard dimensions, such as, for example, 3.2 m×1.6 m. After placement on the work station, the cardboard may be held down in a horizontal orientation a suction hold-down, while cutting and scoring process steps are completed. Such cutting operations generate waste material that has to be separated later on from the desired, or processed, sheet material.

Another potential difficulty is when sections of cut material are not properly engaged by the suction cups, in which case such sections may not be properly lifted or may come loose during transport to the stacking work station by the array of suction cups.

Generally, time is lost owing to the above difficulties, and even when such difficulties do not arise, a minimum time will be needed for workers to safely move planiform articles, during which expensive equipment is left idle.

As a result, in some production environments it is still preferred to use workers to handle the sheet material, both the place the sheet material at the processing station and afterwards when the desired material and waste material is to be moved off the processing station. An advantage of this is that the waste material can be manually separated at the same time as the desired material is stacked, which can save time in the next processing step. There are, however, many disadvantages to using human hands to perform such work, including cost, speed and accuracy of handling and placement of the sheet material.

It is an object of the present invention to provide an automated sheet material cutting and handling system for producing sheet material articles and also a method of producing sheet material articles using an automated sheet material cutting and handling system, that addresses at least some of these problems.

SUMMARY OF THE INVENTION

According to a first aspect of the invention, there is provided a method of producing sheet material articles, each of said articles having a planar shape formed by at least one cut made through a planiform blank, using an automated sheet material cutting and handling system, said system comprising a cutting device and a cutting surface with a suction hold-down, a suction lifting apparatus, and a robotic actuation system for moving the suction lifting apparatus, the suction lifting apparatus comprising at least one suction lifting head including a first suction lifting head, the or each suction lifting head providing a downwardly oriented suction lifting portion and the first suction lifting head providing a first downwardly oriented suction lifting portion, wherein said first suction lifting portion comprises a substantially planar suction lifting plate for applying, in use, suction through a plurality of downwardly oriented holes in said plate; wherein the method comprises the steps of:

i) using an adhesive to adhere a resiliently compressible template to the suction lifting plate, said template having a template shape which covers over said holes across a first portion of said suction lifting plate while leaving exposed said holes across a second portion of said plate, said template blocking suction through said covered holes while leaving unobstructed suction through said exposed holes;

ii) with said blank held in place on the cutting surface by the suction hold-down, using the cutting device to make said at least one cut in said blank to form said planar shape in said cut blank, said at least one cut separating a first portion of said cut blank from a second portion of said cut blank, and said planar shape being provided by one of said portions of said cut blank, and the template shape substantially corresponding with a shape or outline of the first portion of said cut blank;

iii) using the robotic actuation system to move the first suction lifting head to place the suction lifting plate over said cut blank with the template shape being in registration with said shape or outline of the first portion of said cut blank and then making contact between the template and said first portion to resiliently compress said template against the first portion of said cut blank and to locate said exposed holes opposite the second portion of said cut blank;

iv) substantially releasing said suction hold-down of the cutting surface and applying suction through said exposed holes to pull the second portion of said cut blank towards said plate while the first portion of said cut blank is pressed against said cutting surface by the template, said resilient compression bringing the second portion of said cut blank into closer proximity with said exposed holes;

v) using said applied suction through said exposed holes to continue said pull of the second portion of said cut blank whereby the second portion of said cut blank is pulled against said plate, while using said resilient compression to maintain pressure by the template against the first portion of said cut blank as the robotic actuation system moves the first suction lifting head away from the cutting surface, thereby separating the first and second portions of said cut blank; and vi) using the robotic actuation system to move the first suction lifting head to deposit said second portion of said cut blank at a first location.

In a preferred embodiment of the invention, the automated sheet material cutting and handling system comprises at least two suction lifting heads.

Also in a preferred embodiment, the automated sheet material cutting and handling system, said system comprises a control system for controlling the operation of the cutting table, the robotic actuation system and the suction lifting apparatus.

Then, prior to step ii), the method may comprise using the robotic actuation system to lift and place one of the blanks on the cutting surface. In a preferred embodiment of the invention, this is done by moving a suction lifting head other than the first suction lifting head so that the corresponding suction lifting portion of this additional suction lifting head lifts and places the blank prior to cutting by the cutting device.

Additionally, or alternatively, after step v), the method may comprise using the robotic actuation system to lift the first portion of the cut blank from the cutting surface and deposit the cut first portion of the blank at a second location. In a preferred embodiment of the invention, this is done by moving a suction lifting head other than the first suction lifting head so that the corresponding suction lifting portion of this additional suction lifting head lifts and places the cut first portion of the blank after the separation of the first and second portions of the cut blank.

Preferably, the template comprises a resiliently compressible substrate, which is compressible under pressure and which relaxes to its original shape when the pressure is relieved. The substrate may, in use, provide substantially of the compressibility of the template.

Preferably, the template comprises an air barrier layer to restrict or block airflow through the substrate in a direction either towards or away from the covered holes in the suction lifting plate. The air barrier layer is most preferably an adhesive layer by which the template is adhered to the suction lifting plate.

Most preferably, the template, in use, compresses without significant lateral expansion. In the context of the present invention, any such lateral expansion is preferably less than 5 mm, and most preferably less than 1 mm. Lateral expansion greater than this is undesirable, as this could cause the template to overlap a cut in the blank.

To help minimise lateral expansion, the resiliently compressible material is a polymeric foamed material, and most preferably an elastomeric open-cell foam, for example polyurethane. The compressibility characteristics of such materials are well-known. See, for example the MSc Thesis by D.V.W.M. De Vries "Characterization of Polymeric Foams", published by Eindhoven University of Technology (2009). The stress-strain responses of such materials in compression testing show a region of linear elasticity (Hookean) at low stresses. In this compression region, cell walls bend, and so the response is due to the elastomeric properties of the material. At moderate pressures, this is followed by a stress-strain region having a lower slope, in which the stresses increase much more slowly. This referred to as a "collapse plateau", as in this region the response is due to cell walls collapsing. At high stresses, this plateau ends in a stress-strain region where stresses increase much more rapidly, and this is due to densification of the fully collapsed cellular material.

Examples of resiliently compressible material include foamed neoprene or urethane sheets.

The foamed material is most preferably permeable to air flow. This has the advantage of reducing the amount of air trapped in the material as it is compressed.

The material is preferably a foamed or open cell material adapted to compress under pressure to a reduced volume and then spring back to its original volume when the pressure is released.

In a preferred embodiment of the invention, the resilient compressibility of the substrate of the template is provided by an air-permeable open-cell elastomeric material.

The substrate is preferably adhered to the suction lifting surface by an adhesive layer that extends over the closed holes of the suction lifting plate to restrict or prevent suction flow through these closed holes also the-permeable open-cell elastomeric material of the template.

The adhesive is most preferably an adhesive layer, that is continuous over said closed holes. The adhesive layer therefore extending over the closed holes to restrict or prevent suction flow through said closed holes.

The adhesive layer is therefore a substantially air impermeable barrier to such suction flow.

Preferably, the resiliently compressible substrate of the template has a thickness of more than a thickness of the planiform blanks to be cut, for example 50% more and most preferably at least double.

Preferably, the substrate has a thickness that is no more than four times the thickness of the planiform blanks.

Most preferably, in step iv) the template is resiliently compressed in contact with the first portion of the blank, the thickness of the template being reduced by this compression by an amount at least as great as the total thickness of the blank. Then, in step vi), the first portion of the blank is pressed against the cutting surface by the relaxation of the resilient compression of the template until after the second portion of the blank has fully separated from the first portion of the blank.

Therefore, the resiliently compressible template provides a stripping force to overcome any stiction in the cut between the first and second portions of the blank, thereby ensuring that the first portion of the blank remains pressed against the cutting surface as the second portion is pulled away by the suction of the first suction lifting portion.

Preferably, during step iii), the suction hold-down is used to hold the second portion of the cut blank on the cutting surface.

In general, the template will be adhered (i.e. stuck fast) to the first downwardly oriented suction lifting portion with an adhesive, for example with an adhesive layer. Preferably, the adhesive layer extends across substantially the full area of the first portion of the suction lifting plate.

The template may be formed and adhered to the first downwardly oriented suction lifting portion as follows. First, a sheet of adhesive-backed resiliently compressible material is placed on the cutting surface. This may be done by hand, but is preferably another one of the suction lifting heads is used to place the adhesive-backed resiliently compressible material on the cutting surface. Most preferably, this is done by the second one of the suction lifting heads used in step ii) to lift and place blanks on the cutting surface.

The resiliently compressible material is compressible under pressure. The resiliently compressible material supports an adhesive layer which is covered over with a peel-off cover layer. The sheet is preferably larger in extent than the shape to be cut from the planiform blanks.

The cutting system is then used to make at least one cut through the adhesive-backed resiliently compressible sheet. This cut substantially corresponds with, and may essentially match or be the same as, the shape of the cuts to be formed in the blanks. In general, the two shapes need not be exactly the same, as long as the template has a shape which serves, in use, to hold down one portion of the cut blank without interfering in the lifting of another portion of the cut blank.

During this cutting process, the adhesive layer and peel-off cover layer are preferably upper-most with respect to the cutting surface on which the sheet rests, so that after cutting, the sheet does not need to be inverted and repositioned on the cutting surface in order to peel off the peel-off cover layer.

The peel-off cover layer is then peeled off on one side of the cut to expose an area of the adhesive substantially corresponding with the shape of the blank to be cut;

The robotic actuation system then moves the first downwardly oriented suction lifting portion of the suction lifting head until the suction lifting plate of the suction lifting portion makes contact with the sheet of resiliently compressible material. A portion of this sheet then becoming adhered to the suction lifting plate where the adhesive has been exposed and this adhered portion has a shape that substantially corresponds with, and may essentially match or be the same as, the shape to be cut from the planiform blanks.

Then the adhesive-backed resiliently compressible material is separated along the cut to remove the resiliently compressible material from the suction lifting plate except for the adhered portion. This step may be done manually, however, if the resiliently compressible sheet is on the cutting surface, the suction hold-down of the cutting surface may be used to pull down the sheet so that the non-adhered portion remains on the cutting surface while the adhered portion is pulled away from the cutting surface.

The shape of the template may be offset around its periphery from the outline or shape in the blanks to be cut so that any misalignment during step iv) in the registration of the template relative to the cut blank less than or equal to this offset does not cause the template to overlap the cut defining the shape of said planar shape. An offset can also accommodate any lateral expansion of the template that occurs when the material of the resiliently compressible template is compressed as this comes into contact with the first portion of the cut blank.

Preferably, any such offset is substantially constant around one or more peripheral edges of the template. The said offset may be at least 0.5 mm. The offset may be no more than 5 mm.

According to a second aspect of the invention, there is provided a method of using an automated sheet material cutting and handling system to apply a template to a downwardly oriented suction lifting plate of a movable suction lifting apparatus, said plate comprising a plurality of holes in a downwardly oriented suction lifting surface of said plate and the sheet material cutting and handling system comprising a cutting surface being provided with a suction hold-down for securing planiform articles to said surface during cutting of said articles by a cutting device of said system, wherein the method comprises the steps of:

a) using the movable suction lifting apparatus to place a first planiform article on the cutting surface, said article having a substrate that is resiliently compressible under pressure, and having an adhesive layer on said substrate and a peel-off cover layer over said adhesive layer, said cover layer being uppermost relative to the cutting surface, and said first planiform article being larger in extent than a desired first shape to be formed by cutting of said first planiform article by the cutting device;

and then with the first planiform article being held down to the cutting surface by the suction hold-down, the method further comprises the steps of:

b) using the cutting device to make at least one cut through said first planiform article to form said first shape;

c) peeling off the cover layer on one side of said at least one cut to expose a first area of said adhesive layer, said exposed area of adhesive facing upwards over a first portion of said substrate and a second portion of said substrate having a second area of said adhesive layer continuing to be covered by said cover layer;

d) using the movable suction lifting apparatus to move said plate until said suction lifting surface makes contact with the first planiform article such that the first portion of said substrate becomes affixed to said plate as said exposed first area of the adhesive layer comes into contact with said suction lifting surface and then using the movable suction lifting apparatus to move said plate away from the cutting surface;

wherein said adhesion of the adhesive between said plate and the first portion of said substrate is stronger than the suction hold-down securing the first portion of said substrate to the cutting surface, whereby the first and second portions of said substrate are separated as the movable suction lifting apparatus moves said plate away from the cutting surface, thereby leaving the first portion of said substrate affixed to said plate for use as a resiliently compressible template that covers over and blocks some of the holes in said suction lifting surface while leaving exposed and open other ones of said holes not covered over by the template, and wherein the substrate is air permeable, and said covered holes are covered over by said first area of adhesive, said adhesive over said holes serving in use to restrict or block air flow through said covered red holes while leaving unobstructed suction through said exposed holes.

Also according to a third aspect of the invention there is provided an automated sheet material cutting and handling system for producing sheet material articles, each of said articles having a planar shape formed by at least one cut made through a planiform blank, said system comprising a cutting surface provided with a suction hold-down for securing planiform articles to said surface during cutting of said articles by a cutting device, a suction lifting apparatus, a robotic actuation system for moving the suction lifting apparatus, and a control system for controlling the operation of the cutting device and the suction lifting apparatus, the suction lifting apparatus comprising at least one suction lifting head, said suction lifting head providing, in use, a first suction lifting portion, said suction lifting portion comprising a substantially planar suction lifting plate for applying suction through a plurality of downwardly oriented holes in said plate, wherein the control system is configured to operate the cutting device to make said cut through said planiform blank and a resiliently compressible template is adhered by an adhesive to the suction lifting plate, said template having a shape that substantially corresponds with a shape or outline of a portion of said blank formed by at least one cut made by said cutting device and which covers over said holes across a first portion of the suction lifting plate while leaving exposed holes across a second portion of said plate, said template blocking suction through said covered holes while leaving unobstructed suction through said exposed holes.

Preferably, the template comprises an elastomeric open-cell, or "foamed", material substrate.

BRIEF DESCRIPTION OF THE DRAWINGS

The invention will now be further described, by way of example only, and with reference to the accompanying drawings, in which.

DETAILED DESCRIPTION

Figure 1:
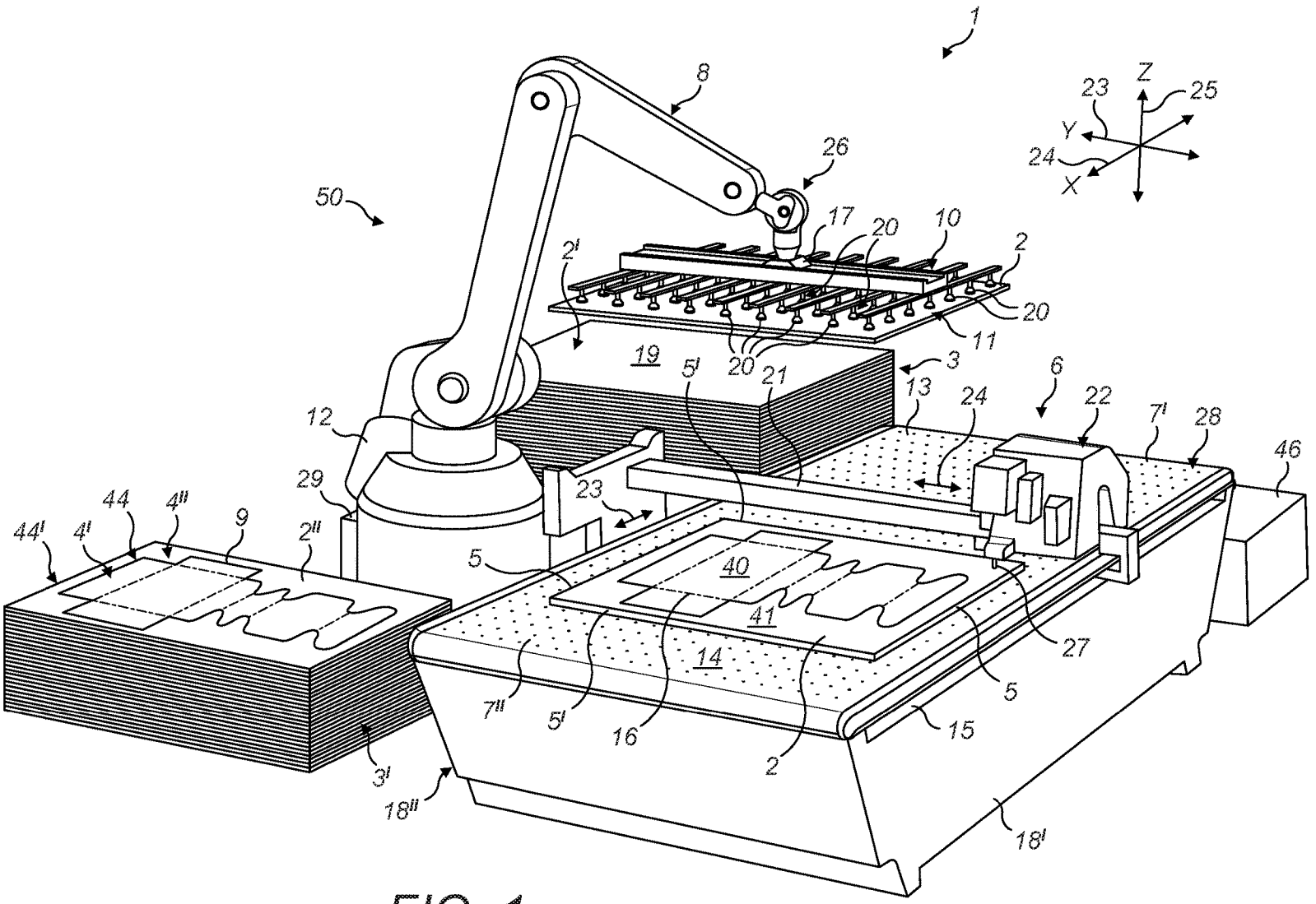
FIG. 1 Prior Art
FIG. 1 is a perspective view of a sheet material handling apparatus for lifting, transporting and placing planiform articles at a work station, according to the prior art, in which a multi-axis robot arm is configured to manipulate a suction lifting apparatus comprising one suction lifting head with an array of suction cups, to lift sheet corrugated cardboard from a feeding stack, place the cardboard on a cutting surface of an automatic cutting system, and then remove the cut cardboard from the cutting surface and stack the cut cardboard sheets in an output stack.

FIG. 1 shows a prior art sheet material handling apparatus 1, for cutting and handling planiform articles, which in this example are rectangular sheets of corrugated cardboard 2, having two opposite short sides or edges 5 and two opposite long sides or edges 5'. In this example, the sheets are moved between three locations, moving from an input stack 3 of fresh uncut sheets 2', which will be referred to as planiform "blanks", onto either a first portion 7' or a second portion 7" of a cutting surface 14 of an automated cutting system. In this example, the cutting surface 14 is provided by a cutting table 6, however, the cutting surface could be provided by other types of machine. After cutting the sheets are moved onto an output stack 3' of cut sheets 2". Each cut sheet 2" has a first portion 4' and a second portion 4", separated by a discontinuity 9 in the material which is a cut (I.e. an incision) made fully through the planiform blank. In this example, the first portion 4' is a useful product, here the material for a folded cardboard box, and the second, surrounding portion 4" is waste material, however, in principle for other cut products, this could be reversed, with the waste material area being surrounded by the useful area of material.

The cut 9 is therefore continuous around the first portion 4' such that the line of the cut defines and is therefore congruent both with an outer perimeter of the first portion 4' and an inner perimeter of the second portion 4". In this example, the first portion has opposite top and bottom sides with an area 40 bounded by one outer boundary or perimeter 44, which in this example is provided by entirely by the cut 9, and the second portion has an area 40' bounded by one outer boundary or perimeter 44', which in this example is provided entirely by the four sides 5, 5' of the cut blank 2, and one inner boundary 44", provided by the cut 9. The first portion 4' therefore has a outline or shape 44 defined by its outer boundary or perimeter and the second portion 4" therefore has an outline or shape 44', 44" defined its outer boundary or periphery and its inner boundary.

In other examples, it may be the case that one or more cuts intersect one or more of the edges 5, 5' of the blank such that one or more lengths of the boundary or perimeter of the first portion 4' and/or the second portion 4" so formed are provided by a corresponding section of the original sides or edges 5, 5' of the blank.

In this example, the cutting table 6 is an automated cutting table, such as that supplied by supplied by Esko-Graphics bvba under the brand name "Kongsberg Automate" (Trade Mark).

The sheet material cutting and handling apparatus 1 comprises a substantially planar suction lifting head 10 and associated air compressor 29 that together provide a suction lifting apparatus and which are operable to apply a suction lift to the articles to be handled, and a robotic actuator 50 for moving the suction lifting head 10. The robotic actuator in this example comprises a multi-axis robotic arm 8 operating under the control of controller 12, that is configured to raise, move, rotate and lower the suction lifting head 10 in order to lift, transport and place the planiform blanks 2 and cut sheet material articles 4' and associated waste material 4" through a cycle of operation. The operation of the robotic arm 8, and also the application of a source of vacuum air pressure (i.e. negative air pressure relative to ambient air pressure) through the suction lifting head 10 carried by the arm, is controlled by the controller 12. In use, the robotic arm 8 lifts a fresh cardboard sheet 2' taken from the input stack 3 and deposits this either on the first side or second side 7', 7" of the cutting surface 14. The details of how a robotic arm 8 may be controlled by the controller 12 will be familiar to those skilled in the art, and so will not be further described in detail.

The automated cutting table 6, which is also well-known by those skilled in the art, comprises the cutting surface 14, which is provided by a cutting system suction hold-down plate 28 that is perforated by a plurality of apertures, gaps, perforations or other such features for generating a suction pressure difference or airflow, all of which such features are referred to herein as "holes" 13.

Behind the holes 13 is at least one plenum chamber 60 connected to a source of vacuum pressure 46 (i.e. negative air pressure relative to ambient air pressure). The cutting surface 14 is therefore also a suction hold-down surface. In this example, the cutting surface 14 is rectangular and fixed relative to a cutting head 22, but alternatively, the cutting surface may be movable, whether or not the cutting head is fixed or movable.

The holes 13 provide air channels through the suction hold-down plate 28 from at by which vacuum or negative air pressure is applied to articles on the cutting surface 14. The holes 13, which may be backed by at least one plenum chamber 60, may be arranged regularly in an array as shown, or may be irregularly spaced, or arranged in any convenient pattern. In general, the automated cutting table 6 will be controller by a controller, which may be a controller that is dedicated just to the operation of the automated cutting table, in which case this controller may be in communication with other controllers such as the controller 12 for the robotic arm 8, in order to synchronise the operation of the automated cutting table 6 with the robotic actuator 50. In this example, however, the controller 12 for the robotic arm 8 also controls the operation of automated cutting table 6. The source of vacuum or negative pressure 46 for the automated cutting table 6 can therefore be switched on and off by the controller 12 to provide a suction hold-down. In this way, the cutting surface 14 of the cutting table 6 can securely hold down, and release any sheet material placed on the cutting surface.

In FIG. 1, one cardboard sheet 2, for which cutting and creasing operations have just been completed, is shown on the second side or half 7" of the cutting surface 14. The robotic arm 8 is shown in the process of moving the next, fresh cardboard sheet 2 toward the cutting table 6 for deposition on the first side 7' of the cutting surface 14, following which the controller will release the suction hold-down on the finished sheet 2 so that the arm 8 can place the suction lifting head 10 on top of the sheet 2 on the output side 7" of the cutting surface, prior to lifting of the finished sheet into the output stack 3'. While the arm 8 is handling a finished sheet lifted from either one of the cutting surface sides 7', 7", the movable cutting head 22 starts work on the newly deposited sheet, held down and therefore secured by suction pressure on the other one of the sides of the cutting surface.

The suction lifting head 10 has a substantially planar suction lifting portion 11 comprising a regular square or rectangular array of suction lifters, which in this example are downwardly oriented suction cups 20. The suction cups each act to lift substantially within a common plane. The suction lifting portion 11 may therefore be said to be "substantially planar". Each suction cup is provided with a suction pressure from a source of vacuum pressure (i.e. negative air pressure relative to ambient air pressure), which may be driven from the air compressor 29. For sake of clarity, connecting air lines, which are in themselves conventional, are not shown between the air compressor 29 and each suction cup 20. The suction cups 20 all lie in a plane so that these may be placed on a top side 19 of one of the planiform blanks 2' to be lifted by the applied suction lifting force.

Although not illustrated, as an alternative to suction cups, it is also known to use a suction lifting portion comprising a perforated suction plate for applying suction through a plurality of downwardly oriented holes in the plate. Such holes may be arranged regularly in an array such as that 13 shown extending across the cutting surface 14, or may be irregularly spaced, or arranged in any convenient pattern.

In either case, the suction lifting head 10 is connected at a midpoint by a mounting bracket 17 to a manipulating end 26 of the robotic arm 8. The suction lifting head 10 is therefore substantially balanced about its midpoint.

The cutting head 22 is movably mounted on a rail 21 such that the head 22 can be moved left or right in a Y-direction 23, perpendicular to an X-direction 24. In this example, the X-direction is parallel with the length of the rectangular suction hold-down plate 28 and the Y-direction is parallel with the width of the suction hold-down plate.

The rail itself is movably mounted to a pair of tracks, one of which 15 is visible in FIG. 1, that extend along opposite first and second sides 18', 18" of the cutting table 6 such that the rail 21 and therefore the cutting head 22 can be moved forwards or backwards in the X-direction 24.

The cutting head 22 houses a cutting device in the form of a reciprocating vertical blade 27 which when lowered in a Z-direction 25 cuts the cardboard 2 along a line defined by the combined movement of the belt and head. The blade will normally be surrounded by a cylindrical shield—this is omitted from the drawings so that the blade can be seen. Score lines, or crease lines (indicated schematically by dotted lines 16), may optionally be formed in a similar manner by making an impression or partial cut in a top surface of the sheet, either by using of the blade 27 which is run along the top surface of the sheet 2 to create an impression or partial cut in the sheet, or by a scoring wheel (not illustrated) mounted to the actuator. The impression or partial cut then facilitates later folding of the cardboard material.

The cuts 9 or fold lines 16 for more than one such box may be made in a single such sheet, depending on the size of the boxes being formed.

The separation of the first and second portions 4', 4" of the cut blanks 2" must then be performed in a separate process, usually a manual process, which is inconvenient.

Figure 2:
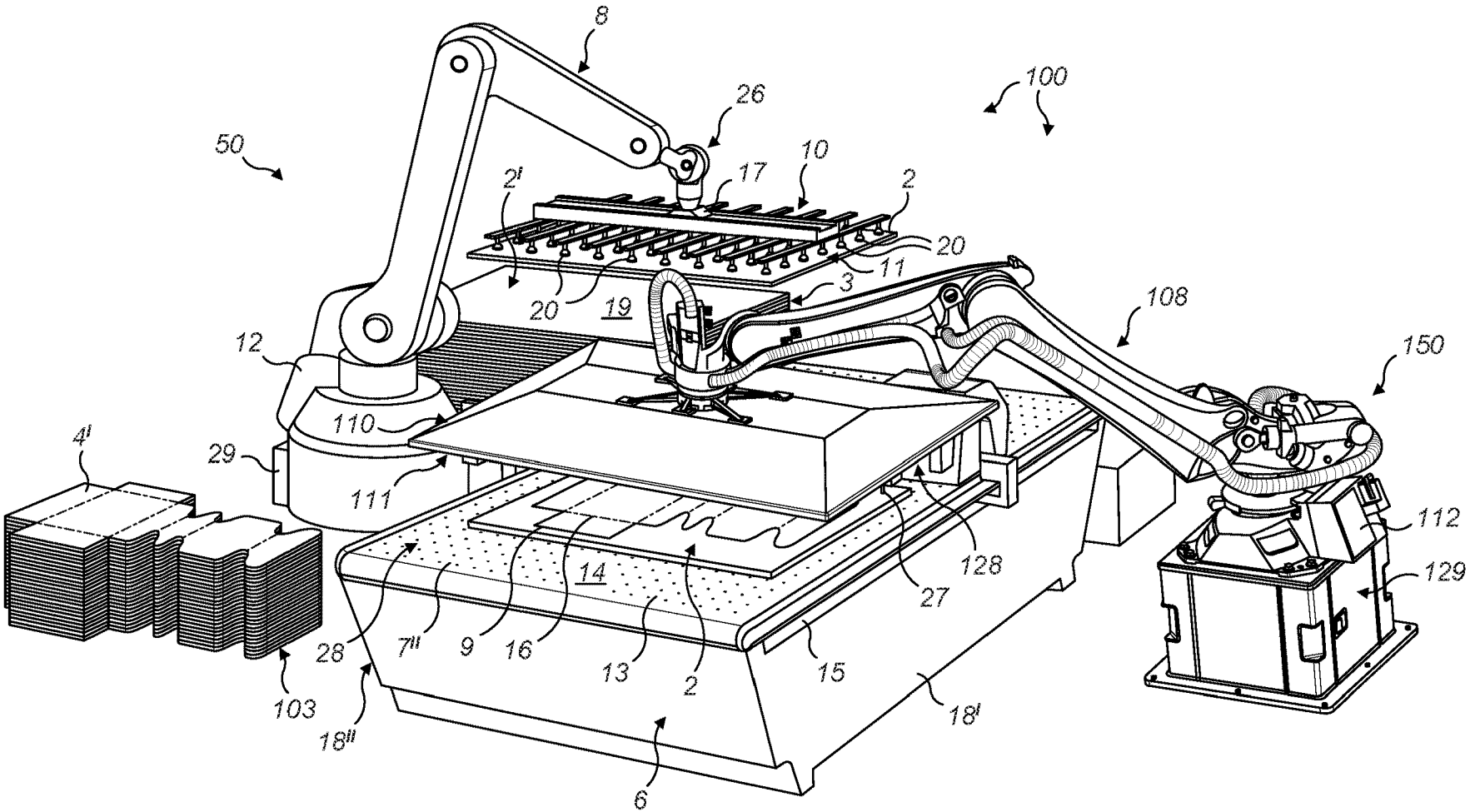
FIG. 2 is a perspective view of a sheet material cutting and handling apparatus for use in method of producing sheet material articles according to a preferred embodiment of the invention, showing a cut blank on the cutting surface immediately prior to separation and lifting of a cut article by another suction lifting head having a downwardly-facing planar first suction lifting portion to which a template has been adhered.
Figure 3:
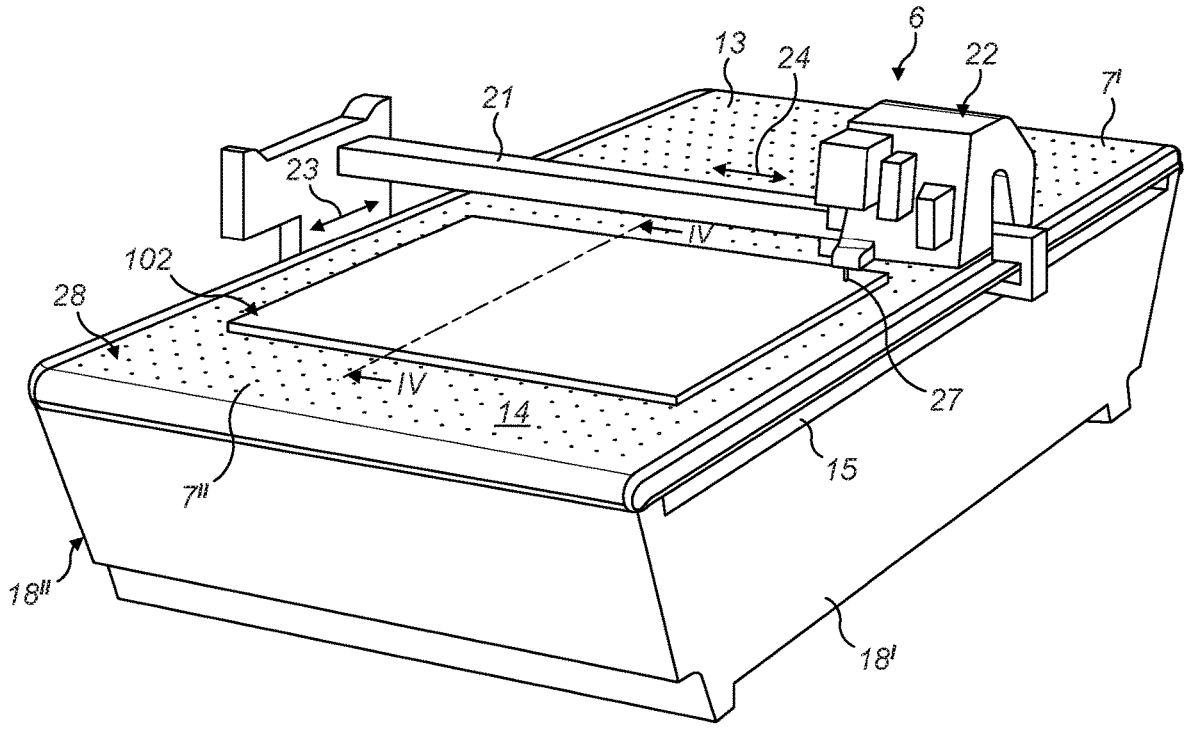
FIG. 3 is a perspective view showing just the cutting surface on which a sheet of adhesive-backed resiliently compressible material has been placed, for example an adhesive-backed substrate of elastomeric open-cell, or "foam", material.

The invention addresses this issue with the apparatus and method described below. A preferred embodiment of an automated sheet material cutting and handling system 100 for producing sheet material articles is illustrated in FIG. 2, the operation of which is shown in detail in FIGS. 3 to 16. In these drawings, components which correspond with those illustrated and described in relation to FIG. 1 are indicated using the same reference numerals.

The automated sheet material cutting and handling system 100 has more than one suction lifting head. In addition to the movable suction lifting apparatus such as that 10, 29, 50 described above (and which could use either suction cups 20, as illustrated or a substantially planar lifting plate perforated with suction holes) used to load and unload the cutting surface 14 of the cutting table 6, there is another movable suction lifting apparatus 110, 129, 150 comprising an additional source of vacuum, i.e. negative, pressure 129 connected to an additional suction lifting head 110 which in use is moved by a robotic actuator 150. This additional suction lifting head has a substantially planar suction lifting portion 111 comprising a perforated suction lifting plate 128 behind which is at least one plenum chamber 160 for applying suction through a plurality of downwardly oriented apertures, gaps, perforations or other such features for generating a suction pressure difference or airflow, all of which such features are referred to herein as "holes" 113 (see also FIGS. 7 to 9 and 11 to 15).

The holes 113 provide air channels through the suction lifting plate 128 behind which a negative or vacuum air pressure is applied. The holes may be arranged in any convenient pattern, and may even be irregularly spaced for example is in a sintered gas permeable surface, but are preferably arranged in an array, for example spaced apart on a regular grid, forming an array of holes similar in size and spacing to those holes 13 in the cutting surface 14 of the cutting system 6. A preferred example of such a suction lifting head having a substantially planar suction lifting portion is disclosed in PCT/162018/050215, the full contents of which are hereby incorporated by reference.

In this example, the holes 113 in the suction lifting plate 128 are preferably on centres spaced apart by between about 5 mm and 30 mm and more typically about 15 mm to 20 mm. The holes are each normally about 1 mm and 1.5 mm in diameter, and most preferably about 1.3 mm in diameter. The thickness of the metal plate in which the holes are made is about 1.5 mm. The source of vacuum pressure applied to the holes is usually at the high end of what is termed "low vacuum", and is typically between about 0.1 and 0.5 of atmospheric pressure, i.e. between about 10 kPa and 50 kPa, and is most preferably in the bottom end of the range, about 10-20 kPa.

In the following description, this additional suction lifting apparatus will hereinafter be referred to as the "first" suction lifting apparatus 110, 129, comprising a "first" suction lifting head 110 with a "first" substantially planar suction lifting portion 111.

Therefore, the suction lifting apparatus 10, 29 first described above will hereinafter be referred to as the "second" suction lifting apparatus, comprising a "second" suction lifting head 10 with a "second" substantially planar suction lifting portion 11. Similarly, the robotic actuator 50 first described above will be described as a "second" robotic actuator, which in this example comprises a "second" robotic arm 8, operating under the control of a "second" controller 12.

The first suction lifting head 110 is moved by its own first robotic actuator 150, which in this example comprises a multi-axis first robotic arm 108. The first robotic actuator 150 operates under the control of a first controller 112. The operation of the first robotic arm 108, and also the application of a source of vacuum pressure through the first suction lifting head 110 carried by the arm, is controlled by the first controller 112.

The first controller 112 is linked to the second controller 12, by which the movement of the second suction lifting head 10 is synchronised with the movement of the first suction lifting head 110. The various robotic actuators provide a robotic actuation system 50, 150 and the linked controllers together provide an automated control system 12, 112. As will be described below, the invention also differs from the prior art in the operation of the automated control system 12, 112.

A main feature of the invention is the use of a resiliently compressible template 30 that is affixed to the first substantially planar suction lifting portion 11 with an adhesive, preferably an adhesive layer than extends fully across the masking area of the template. that the template performs more than one function. The template 30 masks the applied suction from the first suction lifting head 10, and also provides a stripping force to overcome any friction along the cut line 9 to help separate the different portions 4', 4" of the cut blank 2, so that these do not have to be separated, manually or otherwise, in a later process. The bulk of the template 30 is a resiliently compressible material, which is compressible under pressure and which relaxes to its original shape when the pressure is relieved. The material may be an elastomeric material, particularly an air-permeable elastomeric material and most preferably is a foamed or open cell material adapted to compress under pressure to a reduced volume and then spring back to its original volume when the pressure is released. The template 30 is adhered to a downwardly facing suction lifting surface 114 of the first suction lifting portion 111 to cover over some 113', but not all, of the holes 113 in the suction lifting plate 128.

A potential benefit of the invention is that the same automated cutting process used to cut the blank 2 may be used to form the template 30 by making a cut (i.e. an incision) 109 in a sheet of adhesive-backed resiliently compressible material 102.

This is illustrated in FIGS. 3 to 6, where the sheet of adhesive-backed resiliently compressible material 102 has been placed on the cutting surface 14 of the cutting table 6.

The cut 109 may, as illustrated, be the same shape and size as the cut 9 made in the cut blanks 2, in which case the template cut 109 will result in a template 30 (i.e. a first cut portion 104') having substantially the same area 140 as that 40 of the first portion 4' of the cut blank 2. Alternatively, the cut 109 may result in a first portion 104' having a slightly lesser area than that 40 of the first portion 4' of the cut blank 2, such that the template 30, when aligned with the first cut portion of the cut blank falls within but substantially covers the area 40 of the first cut portion 4' of the cut blank 2, without any inadvertent overlapping of the cut 9 in the cut blank 2 due to tolerances in the alignment of the template 30 relative to the area 40 of the first portion 4' of the cut blank 2. Such tolerances may be due to the accuracy with which the template 30 may be adhered to the downwardly facing surface 114 of the first suction lifting portion 111, or the limitations in movement accuracy of either the first or second robotic actuators 50, 150. In either alternative, it is the case that the template 30 has a template shape 144 which in this example is an outline formed by the single template cut 109 that substantially corresponds with the outline in of the shape 44 to be cut 9 into the blanks 2.

The material used for the bulk of the template 30 is resiliently compressible such that it is repeatedly compressible and expandable back to its original volume, and preferably provided by a main body or substrate 31 having an open-cell foamed structure, for example polyurethane or other elastomeric material, and is preferably about twice as thick as the blank material to be cut later in the process. The material supports on an upper side an adhesive layer 32 which is relatively thin as compared with the thickness of the substrate (i.e. no more than 10% the thickness of the substrate and most preferably no more than about 1%), and which therefore does not add appreciably to the overall thickness of the template structure. The adhesive layer 32 is covered over with a disposable peel-off cover layer comprising a backing layer 33 and optionally also a release layer 34 that is bonded the backing layer 33 and in contact with the adhesive layer 32, to aid clean separation of the adhesive layer 32 from the backing layer 33. These additional layers are also relatively thin as compared with the thickness of the substrate (i.e. no more than 10% the thickness of the substrate and most preferably no more than about 1%). The backing layer is preferably paper, but may be of any other suitable layer, for example a plastic layer.

This sheet is preferably larger in extent than the outline to be cut from the planiform blanks. It should be noted that the thicknesses of the adhesive layer 32, backing layer 33 and release layer 34 do not add appreciably to the total thickness of the adhesive-backed resiliently compressible material 102, which is dominated by the thickness of the resiliently compressible substrate 31. In this example, the blanks to be cut are 5 mm thick cardboard and the substrate is about 12 mm thick. For the sake of clarity in the drawings, the thickness of the thinner layers 32-34 is exaggerated these are each typically of the order of 0.1 mm in thickness.

The cutting table 6 is then used to make at least one cut 109 through the sheet 102, this cut forming a shape 144 that substantially corresponds with the shape 44 in the first portion 4' of the blanks 2 to be cut later in the process.

The backing layer 33 and optionally the release layer 34 provide a peel-off cover layer, and this may then be manually peeled off on one lateral side of the cut 109 (here, the inside, but for other products, it could be the outside) to expose an area 32' of the adhesive corresponding with the desired template shape 144. This area 32' of the exposed adhesive layer is shown for illustrative purposes only with cross hatching in FIG. 6. The remaining area of adhesive 32 remains concealed beneath the peel off layer 33, 34 and is indicated by reference numeral 32" in the sections of FIGS. 7-9.

Figure 4:
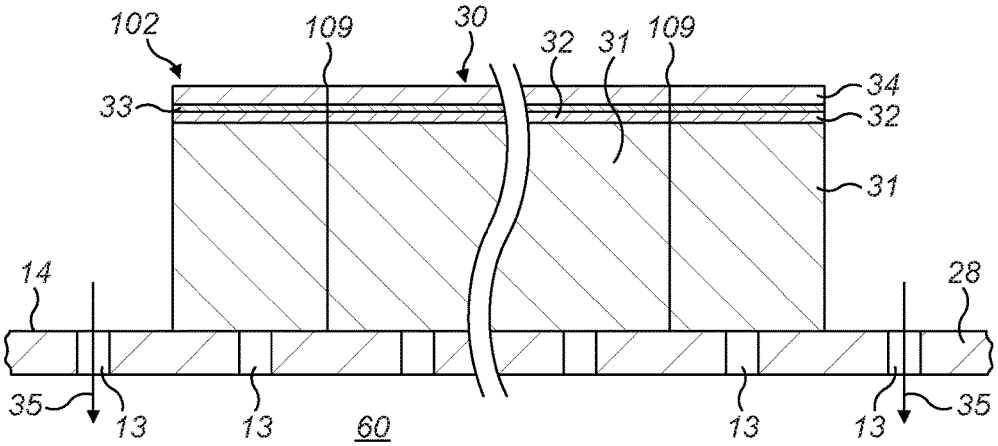
FIG. 4 is a schematic cross-section through the layers used to form the template and the top surface of a suction hold-down plate, taken along line IV-IV of FIG. 3.
Figure 5:
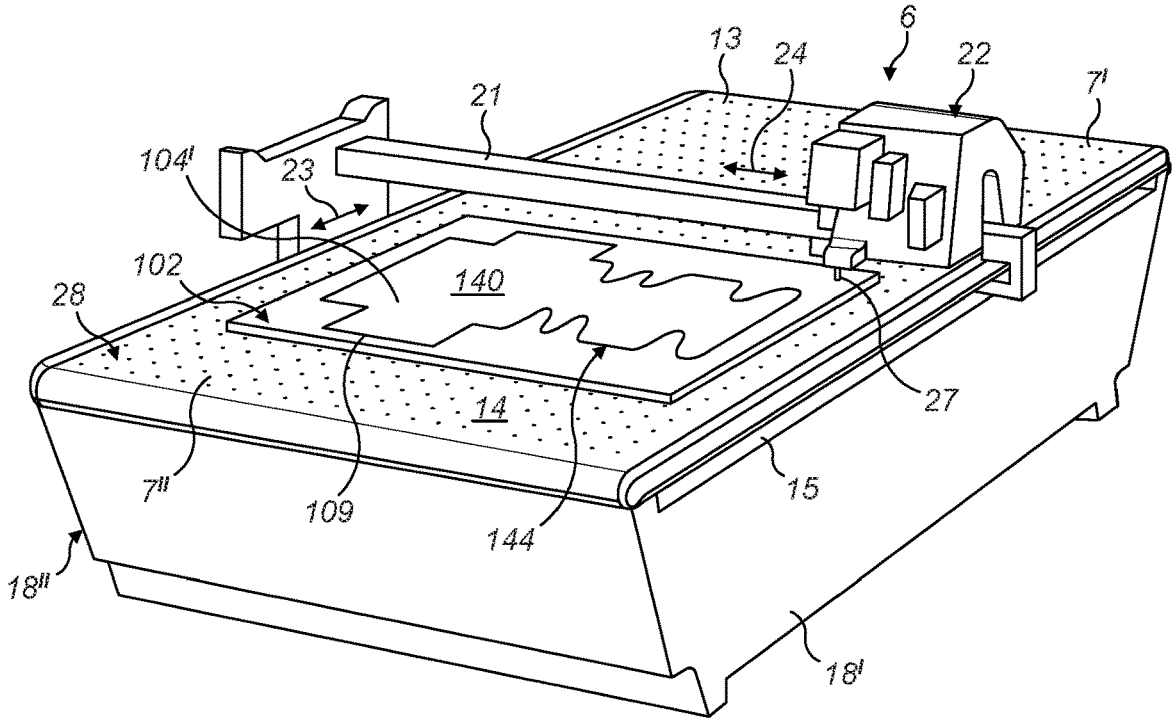
FIG. 5 is a perspective view showing how a cut line is formed along an incision made by the cutting system in the sheet of adhesive-backed resiliently compressible material.
Figure 6:
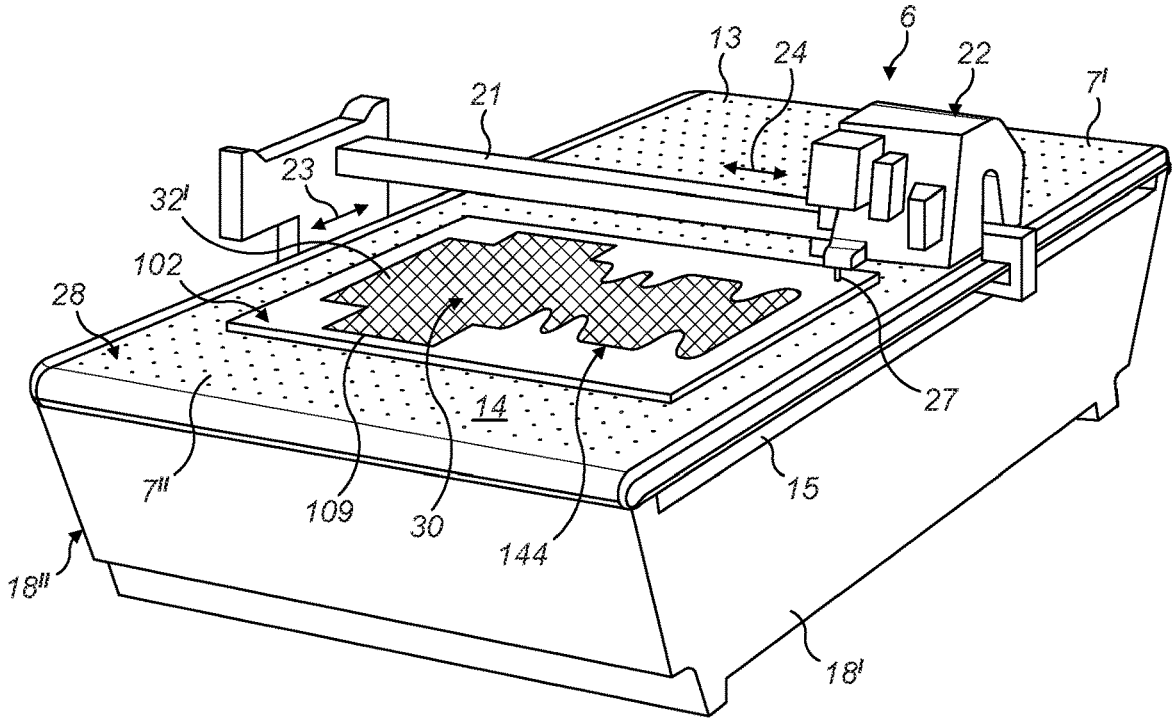
FIG. 6 is a perspective view showing how a cover sheet is peeled off to reveal an adhesive layer atop a substrate that provides the resiliently compressibility of the template.
Figure 7:
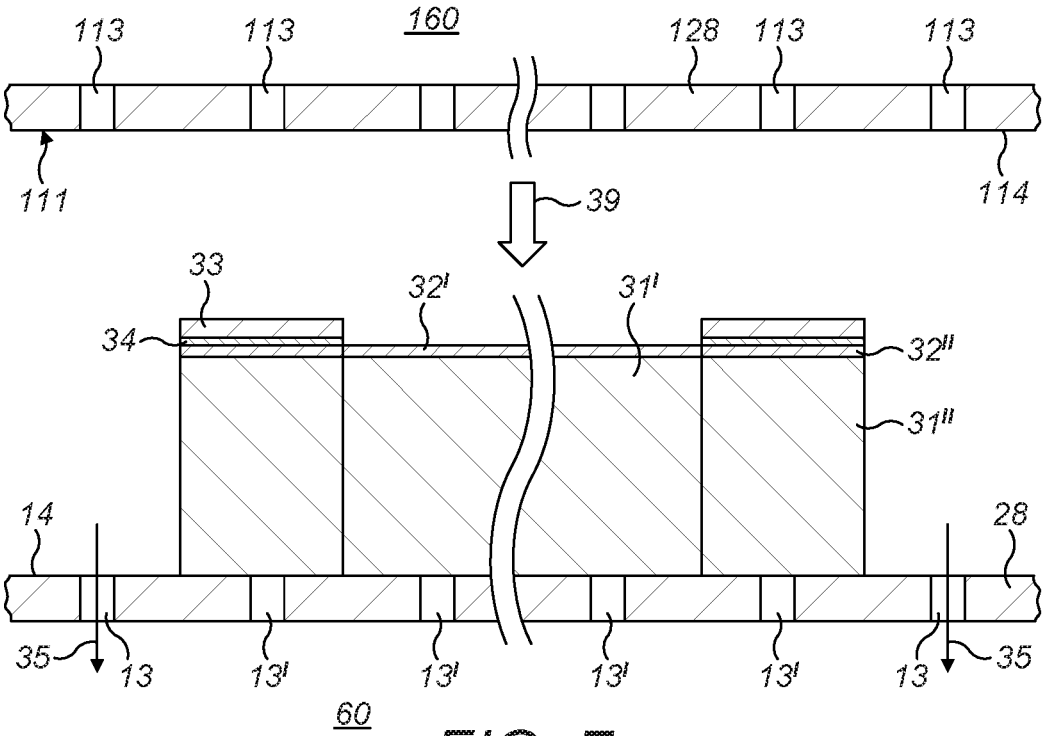
FIGS. 7 to 9 are cross-sections similar to FIG. 4, showing how the suction hold-down of the cutting surface and suction lifting head are controlled to adhere the exposed adhesive, and hence a portion of the foam board to a downwardly directed suction lifting surface of the suction lifting head, while leaving the rest of the resiliently compressible sheet material on the cutting surface of the cutting system.
Figure 8:
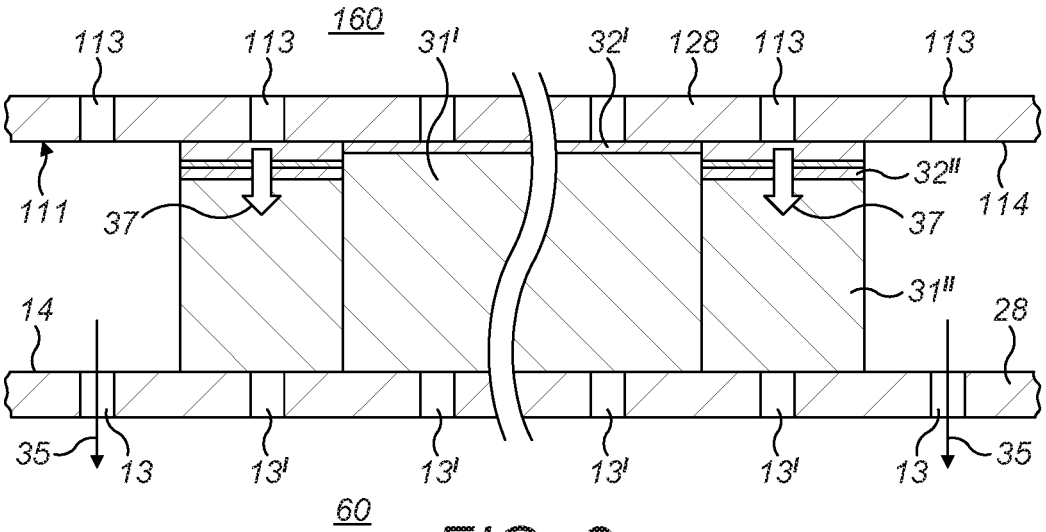

The sheet of adhesive-backed resiliently compressible material 102 is placed on the cutting surface 14, with the exposed area 32' of adhesive facing upwards, and preferably in substantially the same location that the cut blanks will later occupy. This may be done either manually or using the second suction lifting head 10. A negative or vacuum pressure from the source of negative air pressure 46 applied behind the suction hold-down plate 28 creates an airflow 35 through open holes 13, as shown in FIG. 4, and to create a negative pressure behind holes 13' in the suction hold-down plate covered over by the resiliently compressible material 102. The actuation system 108, 112 is then used to lower 39 the first suction lifting portion 111 until the downwardly oriented perforated suction lifting plate 128 makes contact with the sheet of resiliently compressible material 102. Downward pressure is applied by the robotic actuator 150 and the exposed portion of adhesive 32' then is pressed against and becomes adhered to the downwardly facing suction lifting surface 114 of the perforated suction lifting plate 128. The substrate 31 may be compressed during this process, particularly where the protective backing layer remains in place, as indicated schematically by arrows 37.

The suction lifting plate 128 is then lifted away from the cutting surface 14 by the first robotic actuator 150. The adhesion provided by the adhesive layer 32' of the template is stronger than the suction from the applied negative pressure behind the vacuum hold-down plate 28 plus any friction along the cut 109, and so the template is retained to the vacuum lifting plate 128 of the suction lifting portion 111 and separated from a waste portion 102' of the adhesive-backed resiliently compressible material 102, which remains secured to the cutting surface 14 by virtue of the applied negative pressure. In addition, the adhesive layer 32 provides a substantially air impermeable barrier, which isolates the open-cell material of the substrate from the applied upwards pressure from the suction lifting plate 128. The upwards suction from the lifting plate 128 therefore does not interact with the downwards suction from the suction hold-down plate 28 in the region of the first cut portion 104'.

Following this, the waste portion 102' is removed, for example by hand, from the vacuum hold-down plate 28 up to the cut 109 where adhesion has been prevented by the remaining peel-off backing 33, 34. The material is thus removed from the perforated vacuum plate except for the adhered portion, which is then used to provide the template 30 mentioned above.

Figure 9:
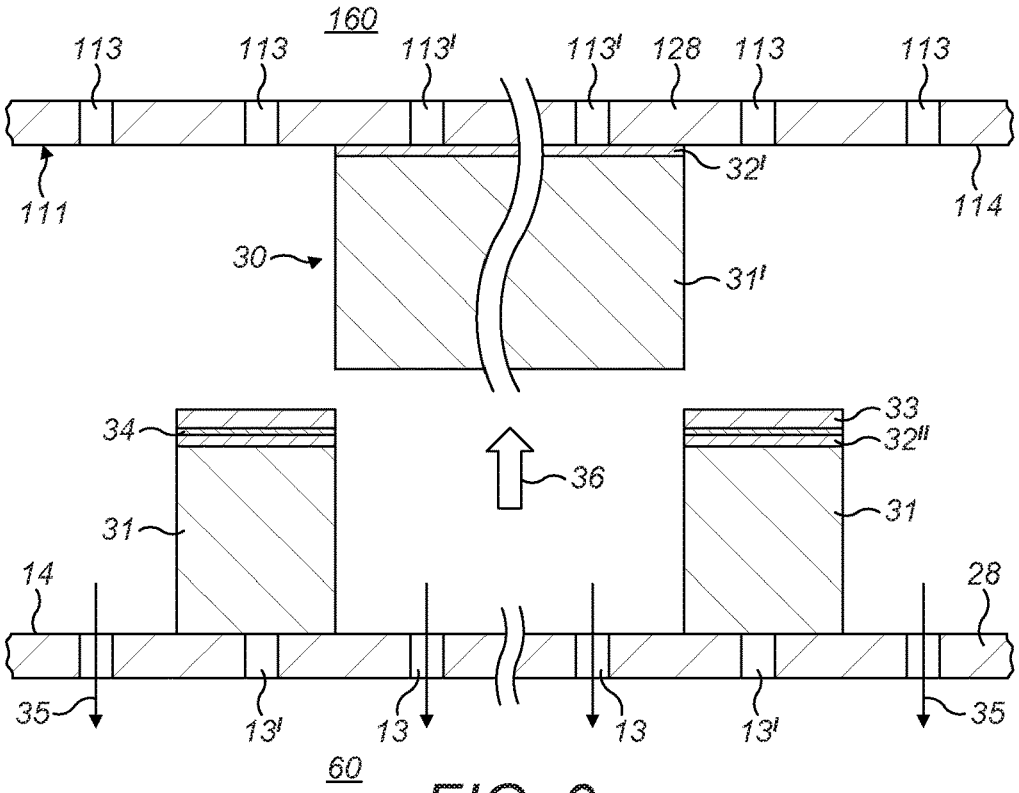

Alternatively, it may be possible to separate the resiliently compressible material along the cut 109 by applying the vacuum hold down 35 through the holes 13 in the vacuum hold-down plate 28 while lifting 36 the first suction lifting portion 111 as shown in FIG. 9.

Figure 10:
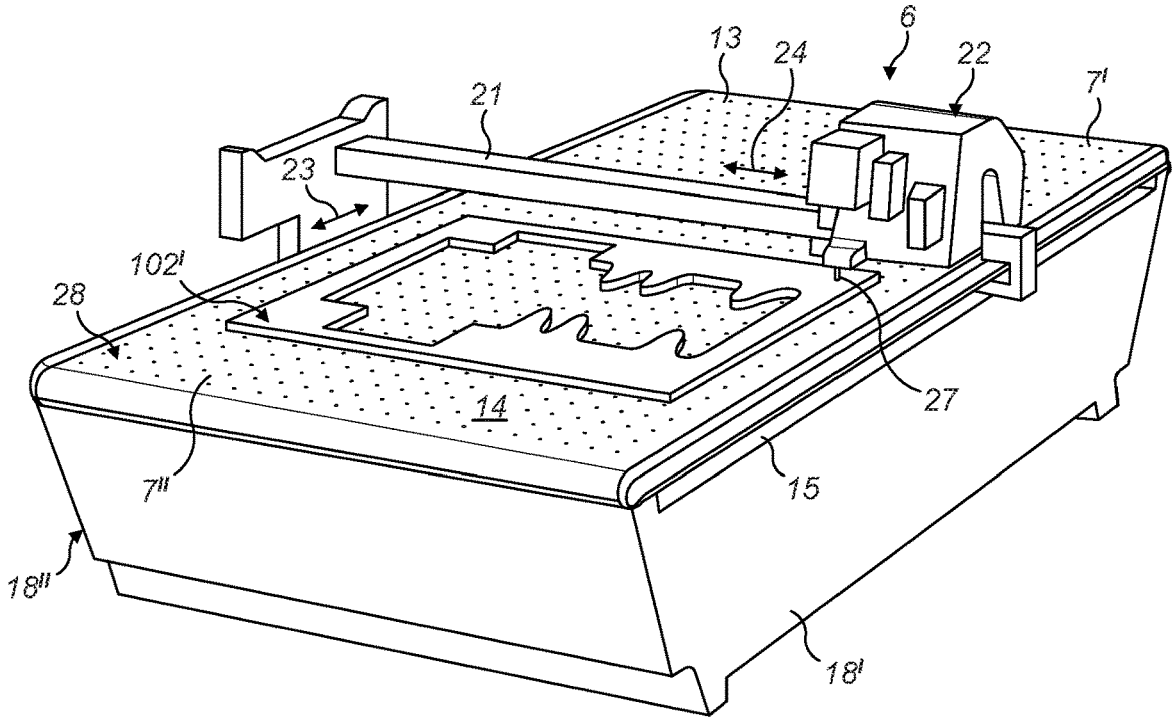
FIG. 10 is a perspective view showing the portion of the resiliently compressible sheet material left on the cutting surface.
Figure 11:
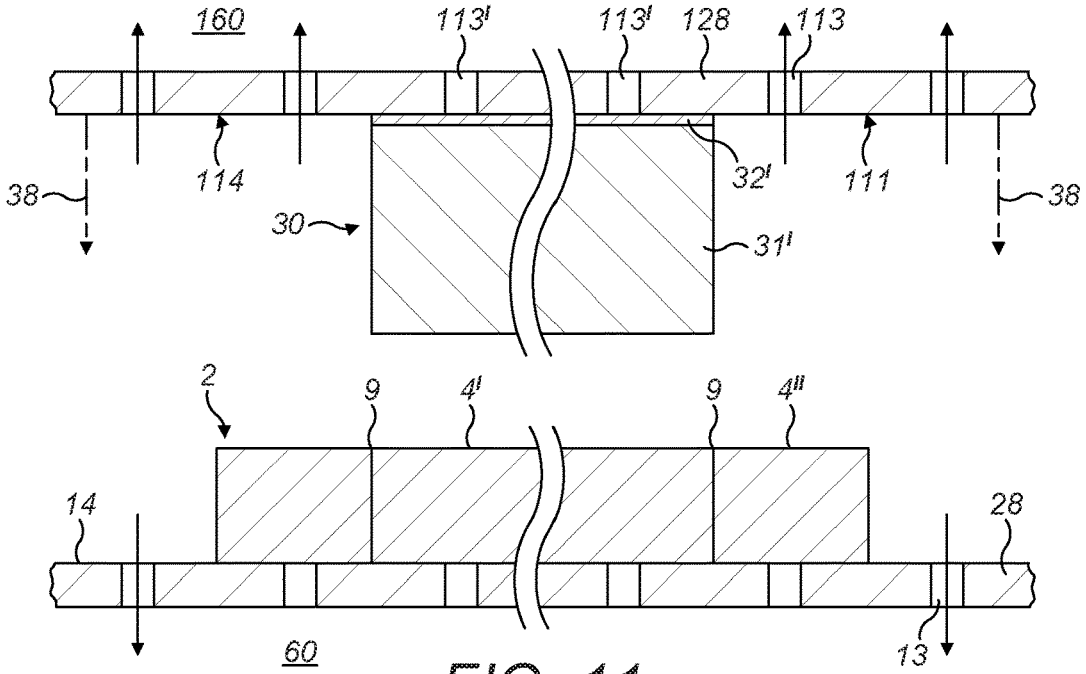
FIGS. 11 to 15 show how the portion of the resiliently compressible sheet material adhered to the lifting head provides a template on the suction lifting portion which both masks the suction lift provided by the suction lifting head and also shows how the material is compressed to provide a stripping force so that only a first portion of the cut blank is lifted from the cutting surface, leaving a second portion behind.

In either case, the shape of a removed portion of the substrate 31' is shown on the cutting surface 14 in FIG. 10, the template 30 having the outline or shape of this missing portion.

FIGS. 11 to 15 then illustrate schematically the remaining steps of the process. The sheet material 2 of the blanks is cut along the line of the cut 9 as described above, dividing the blanks into the first portion 4' and the second portion 4". The cut 9 defines the bounds and hence the planar shape 44 of a product being produced, in this example, cut cardboard sheet for cardboard boxes.

Figure 12:
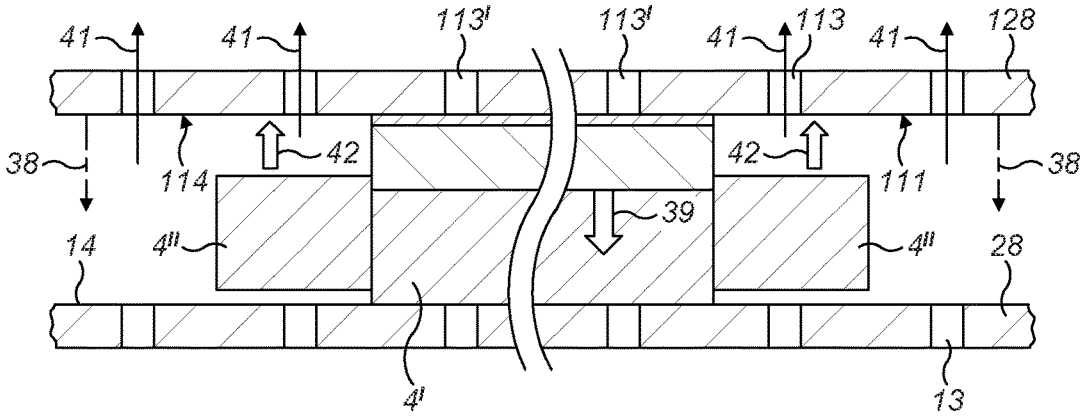

The robotic actuation system 108, 112 is then used to move the first suction lifting head 110 to place the perforated vacuum lifting plate 128 over the cut blank 2 with the shape 144 of the template 30 in registration with the planar shape 44 defined by the cut 9 in the blank. The perforated vacuum lifting plate 128, and hence the first suction lifting portion 111, is then lowered 38 until the downwardly oriented perforated vacuum lifting plate 128 makes contact with and resiliently compresses 39 the template 30 against the first portion 4' of the cut blank 2, as shown in FIG. 12. The compression of the resiliently compressible material 31' of the template 30 transmits a compressive force 39 to the first portion of the cut blank.

Once contact is made, the control system 12, 112 is used to substantially release the vacuum hold-down 35 of the cutting surface 14. By this it is meant that the vacuum hold-down 35 of the cutting surface 14 may be completely released or, alternatively, a residual amount of vacuum hold-down may remain, so long as this is sufficiently small so as not to hinder the subsequent separation of the first and second cut portion 4',4". A residual amount of vacuum hold-down may be beneficial in helping to prevent any lateral shift in the position of the second cut portion 4" on the cutting surface 14 as contact between the template 30 and the second cut portion is released.

Suction 41 may then be then applied through the holes 113 in the perforated vacuum lifting plate 128 to pull the second portion 4" of the cut blank against the perforated vacuum lifting plate except where the first portion 4' of the cut blank is pressed by the resiliently compressible material 31' of the template 30 against the cutting surface 14 by the template. Optionally the first portion 4' may also be compressed, if this is of a compressible material, but this is not necessary, as the process also works with non-compressible cut blanks, as long as the suction 41 is strong enough to influence the second portion of the cut blank as the vacuum lifting plate 128 comes into closer proximity with the second portion 4". To provide this benefit, it is particularly useful if the template 30 has a thickness of more than a thickness of the planiform blanks 2 to be cut.

Most preferably the template 30 has a thickness of at least double the thickness of these planiform blanks. This helps to ensure that the compressible foamed material substrate remains in a region of linear elasticity of the elastomeric material of which it is formed. This performance characteristic is ensured for a wide range of open-cell elastomeric materials when the template thickness is four times the thickness of the planiform blanks.

Figure 13:
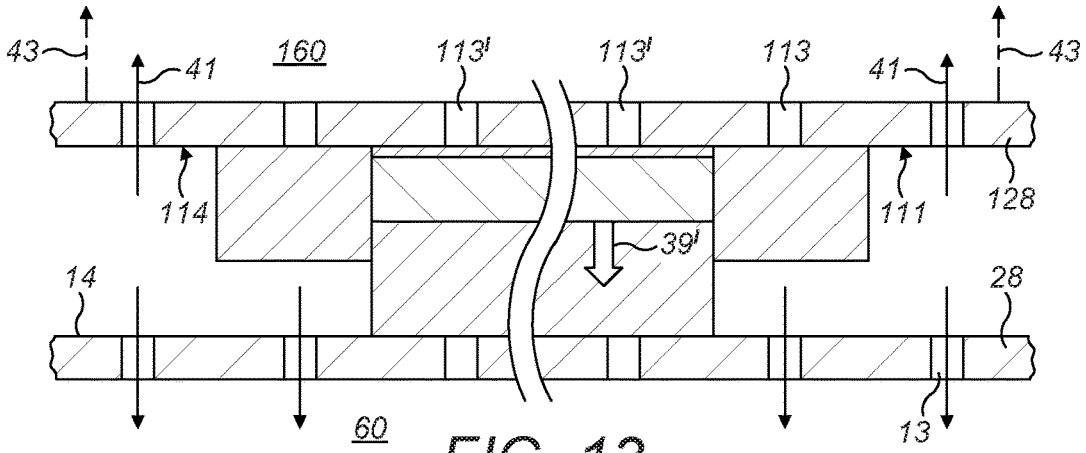

Once the second portion 4" is pulled 42 towards or begins to touch the perforated vacuum lifting plate 128, the robotic actuation system 108, 112 starts to move the first suction lifting head 110 away 43 from the cutting surface 14. The compression of the resiliently compressible material 31' of the template 30 begins to relax, but still applies a compressive force 39' against the first portion 4' of the cut blank, as shown in FIG. 13. Around the time the cut first portion 4' lifts clear of the cutting surface 14, the vacuum hold-down 35 of the cutting surface 14 may be reapplied or, if a residual amount has been maintained, the vacuum hold-down 35 of the cutting surface 14 may be increased, to help stabilise the position of the cut second portion 4".

Figure 14:
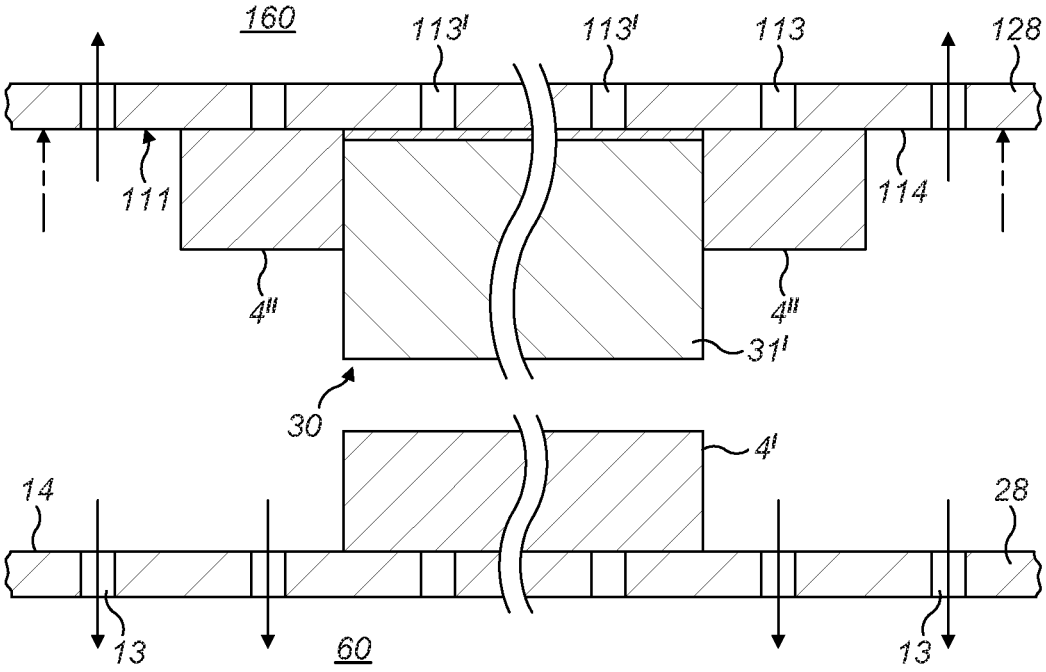
Figure 15:
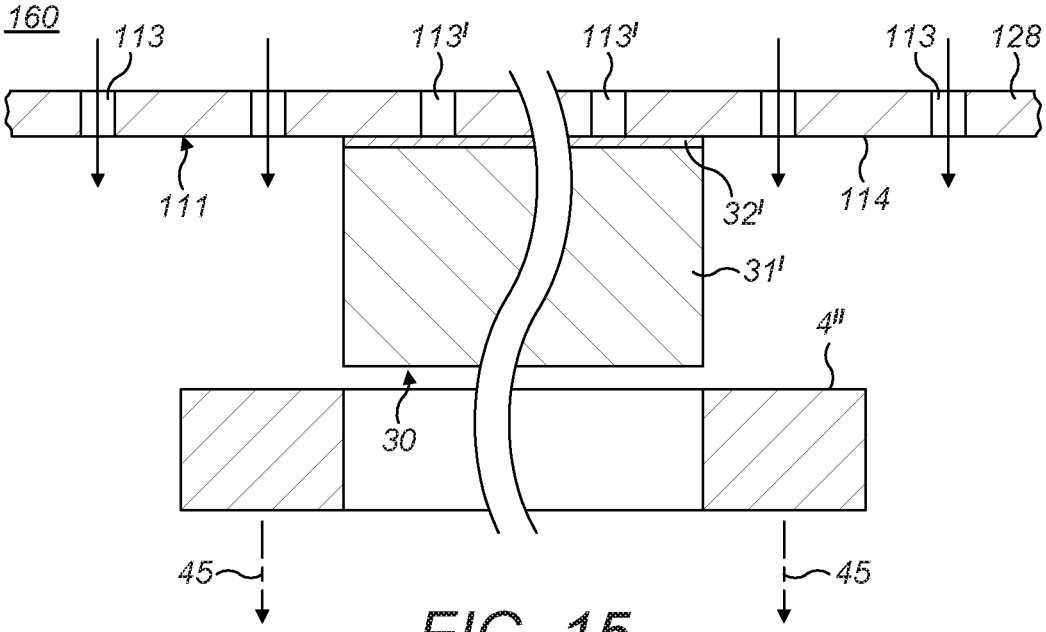

Meanwhile vacuum suction continues 41 to be applied through the holes 113 in the perforated vacuum lifting plate 128 to pull the second portion 4" of the blank firmly against the plate. The resilient compression continues to maintain pressure against the first portion 4' of the blank as the robotic actuation system 108, 112 moves the first suction lifting head 110 away from the cutting surface 14, thereby separating the first and second portions 4', 4" of the blank, as shown in FIG. 14. In this way, the resiliently compressible template 30 provides a stripping function in the process, by providing the force that strips apart the first and second portions 4', 4" of the cut blank.

The robotic actuation system 108, 112 is then used to move the first suction lifting head 110 to a location, in this example a waste bin 120, where the suction is released to deposit 45 the second portion 4" of the cut blank.

Figure 16:
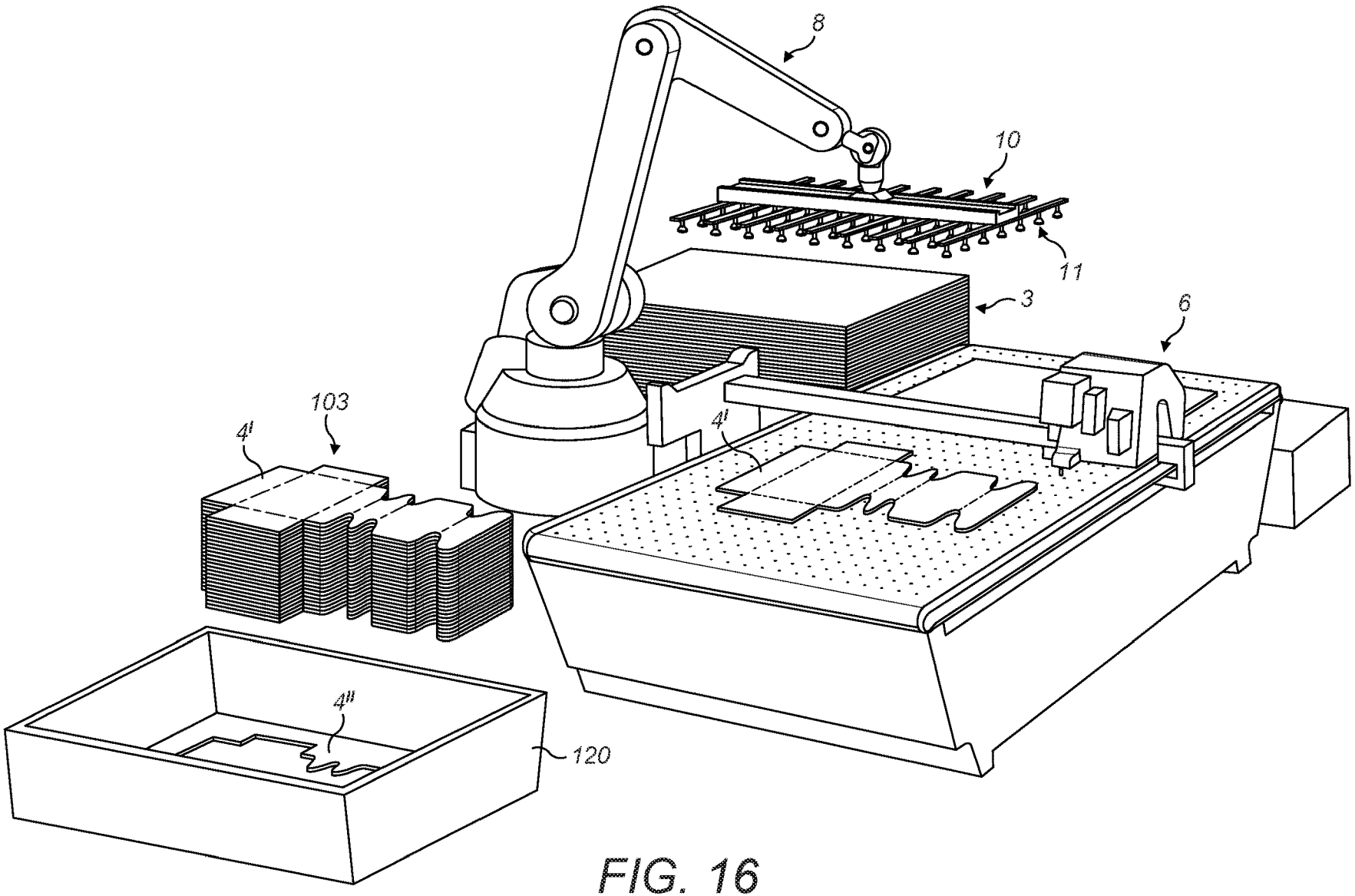
FIG. 16 shows a perspective view of part of the view of the sheet material cutting and handling apparatus of FIG. 2, after stripping of the first portion of the cut blank, leaving the second portion on the cutting surface for subsequent stacking on a stack of finished sheet material articles by the same lifting head initially used to deposit the blank sheets on the cutting surface.

Finally, as shown in FIG. 16, the second suction lifting head 10 is free to be used to lift the first portion 4' of the cut blank from the cutting surface 14 and to deposit this portion at a desired location, in this example an output stack 103 of cut planar articles, ready to be formed into cardboard boxes. Although not illustrated, the first portion 4' may be moved and deposited using other type of sheet handling equipment. For example, a belt conveyor may extend along the sides 18, 18' of the cutting surface, underlapping one or more portions of the second cut portion 4" left on the cutting surface 14. In any of these processes, the vacuum hold-down 35 of the cutting surface 14 may be substantially released so that this does not interfere with the lifting of the second cut portion 4" from the cutting surface 14.

It should be noted that it may in some cases be desirable to use an additional robotically controlled suction lifting apparatus with its own suction lifting head to remove the final cut product from the cutting surface.

It may also be possible to integrate more than one suction lifting head in the same suction lifting apparatus. For example, different heads could be provided on different sides of a common frame that is pivotable about a horizontal axis. The frame could then be pivoted prior to use of one of the heads to bring the suction lifting portion of that head into the correct downward orientation, while another head not in use rotates so that its suction lifting portion moves to face to one side or upwards. One of the heads will have the plate on which the template is adhered and another may, for example, have an array of suction cups used to transport the blanks before cutting or after stripping of waste material by the template.

It should be noted that although the process has been described and illustrated above in the context of the single sheet material article produced from the blank, the principles of the invention are equally applicable to producing more than one article at a time from a blank, in which case there will be more than one correspondingly shaped template adhered to the first downwardly oriented perforated vacuum plate.

It should also be noted that although the process has been illustrated using an example in which it is the waste material which is stripped away from the cutting surface, in some cases it may be that it is the product which is stripped by the first suction head and template with the waste material being left behind on the cutting surface. It could even be the case that both the first and second portion of the cut blank are useful in their own right, in which two useful products are stripped apart by the first suction head and template.

It should also be noted that although the preferred process uses a suction lifting apparatus comprising a second suction lifting head to deposit the blanks on the cutting surface, blanks may be deposited using other types of sheet handling equipment, for example a conveyor belt. Similarly, the material left on the cutting surface after the removal of the rest of the material by the first suction lifting head to which the template is adhered, may be removed by types of sheet handling equipment other than a suction lifting head, particularly if this is waste material. Such waste material may, for example, be swept off the cutting surface by a bar that sweeps the cutting surface, or by sweeping jets of air.

Although the cutting device described above is a reciprocating blade cutter, other types of cutting device may be used, depending mainly on the material to be cut, and whether or not the cutting system needs to be quickly reconfigurable to form different shaped cuts. A laser cutter is fast and readily reconfigurable. A die cutter can be even faster but once made cannot be reconfigured.

In all of these embodiments, it is particularly advantageous if the adhesive layer adhering the template to the suction lifting surface extends across the closed holes 113' to provides a substantially air impermeable barrier. Alternatively, particularly if the adhesive layer is discontinuous, an additional substantially air impermeable layer (not illustrated) may be provided, for example between the adhesive layer and the substrate, to prevent or reduce air leakage into the closed holes 113'. This may have the advantage of increasing the pressure difference across the exposed holes 113, and therefore increasing the lifting force on the second cut portion 42.

In its various embodiments, the invention therefore provides a convenient automated sheet material cutting and handling system apparatus and also a method of producing sheet material articles is using an automated sheet material cutting and handling system.

It is to be recognized that various alterations, modifications, and/or additions may be introduced into the methods, and the constructions and arrangements of parts described above without departing from the spirit or scope of the present invention, as defined by the appended claims.

The invention claimed is:

1. A method of producing sheet material articles, each of said articles having a planar shape formed by at least one cut made through a planiform blank, using an automated sheet material cutting and handling system, said system comprising a cutting device and a cutting surface provided with a suction hold-down, a suction lifting apparatus, and a robotic actuation system for moving the suction lifting apparatus, the suction lifting apparatus comprising at least one suction lifting head including a first suction lifting head, the or each suction lifting head providing a downwardly oriented suction lifting portion and the first suction lifting head providing a first downwardly oriented suction lifting portion wherein said first suction lifting portion comprises a substantially planar suction lifting plate for applying, in use, suction through a plurality of downwardly oriented holes in the suction lifting plate; wherein the method comprises the steps of:

i) using an adhesive to adhere a resiliently compressible template to the suction lifting plate, the template comprising a resilient compressible substrate of an elastomeric material, the substrate having an uncompressed thickness of more than a thickness of said planiform blank and said material being a foamed or open cell material adapted to compress under pressure to a reduced volume and then spring back to its original volume when the pressure is released, and the template having a template shape which covers over the holes in the suction lifting plate across a first portion of the suction lifting plate while leaving exposed the holes in the suction lifting plate across a second portion of the suction lifting plate, the template blocking suction through said covered holes while leaving unobstructed suction through said exposed holes;

ii) with said blank held in place on the cutting surface by the suction hold- down:

using the cutting device to make said at least one cut in said blank to form said planar shape in said cut blank, said at least one cut separating a first portion of said cut blank from a second portion of said cut blank, and said planar shape being provided by one of said portions of said cut blank, and the template shape substantially corresponding with a shape or outline of the first portion of said cut blank; and using the robotic actuation system to move the first suction lifting head to place the suction lifting plate over said cut blank with the template shape being in registration with said shape or outline of the first portion of said cut blank and then making contact between the template and the first portion of said cut blank to resiliently compress the template against the first portion of said cut blank with said exposed holes located opposite the second portion of said cut blank;

iii) substantially releasing the suction hold-down of the cutting surface and applying suction through said exposed holes to pull the second portion of said cut blank on the cutting surface towards the suction lifting plate while the first portion of said cut blank is pressed against the cutting surface by the template, said resilient compression reducing the thickness of the template whereby the second portion of said cut blank is brought into closer proximity with said exposed holes and said applied suction;

iv) using said applied suction through said exposed holes to continue said pull of the second portion of said cut blank whereby the second portion of said cut blank is pulled against the suction lifting plate, while using said resilient compression of the template to continue to press the template against the first portion of said cut blank, whereby the first portion of said cut blank remains held in place on the cutting surface by the resilient compression of the template;

v) using the robotic actuation system to move the first suction lifting head away from the cutting surface, thereby separating said second portion of said cut blank from said first portion of said cut blank; and vi) using the robotic actuation system to move the first suction lifting head to deposit the second portion of said cut blank at a first location.

2. The method as claimed in claim 1, in which said resilient compressibility of the substrate is provided by an air-permeable open-cell elastomeric material, and the substrate is adhered to the suction lifting surface by an adhesive layer that extends over said covered holes to restrict or prevent suction flow through said covered holes and said air-permeable open-cell elastomeric material of the substrate.

3. The method as claimed in claim 1, in which the adhesive is an adhesive layer, said layer extending over said covered holes to restrict or prevent suction flow through said covered holes.

4. The method as claimed in claim 1, in which the substrate has an uncompressed thickness that is at least 50% more than the thickness of said planiform blank.

5. The method as claimed in claim 1, in which the substrate has an uncompressed thickness that is at least double the thickness of said planiform blank.

6. The method as claimed in claim 4, in which the substrate has an uncompressed thickness that is no more than four times the thickness of said planiform blank.

7. The method as claimed in claim 1, in which in step ii) during said resilient compression of the template, the template is compressed in contact with the first portion of said cut blank, the thickness of the template being reduced by said compression by an amount at least as great as the total thickness of the blank, wherein in step v) the first portion of said blank is pressed against said cutting surface by the compression of the template until after the second portion of the blank has fully separated from the first portion of said cut blank.

8. A method of producing sheet material articles, each of said articles having a planar shape formed by at least one cut made through a planiform blank, using an automated sheet material cutting and handling system, said system comprising a cutting device and a cutting surface provided with a suction hold-down, a suction lifting apparatus, and a robotic actuation system for moving the suction lifting apparatus, the suction lifting apparatus comprising at least one suction lifting head including a first suction lifting head, the or each suction lifting head providing a downwardly oriented suction lifting portion and the first suction lifting head providing a first downwardly oriented suction lifting portion wherein said first suction lifting portion comprises a substantially planar suction lifting plate for applying, in use, suction through a plurality of downwardly oriented holes in the suction lifting plate;

wherein the method comprises the steps of:

i) using an adhesive to adhere a resiliently compressible template to the suction lifting plate, the template having a template shape which covers over the holes in the suction lifting plate across a first portion of the suction lifting plate while leaving exposed the holes in the suction lifting plate across a second portion of the suction lifting plate, the template blocking suction through said covered holes while leaving unobstructed suction through said exposed holes;

ii) with said blank held in place on the cutting surface by the suction hold- down:

using the cutting device to make said at least one cut in said blank to form said planar shape in said cut blank, said at least one cut separating a first portion of said cut blank from a second portion of said cut blank, and said planar shape being provided by one of said portions of said cut blank, and the template shape substantially corresponding with a shape or outline of the first portion of said cut blank; and using the robotic actuation system to move the first suction lifting head to place the suction lifting plate over said cut blank with the template shape being in registration with said shape or outline of the first portion of said cut blank and then making contact between the template and the first portion of said cut blank to resiliently compress the template against the first portion of said cut blank with said exposed holes located opposite the second portion of said cut blank, wherein during said resilient compression of the template, the template is compressed in contact with the first portion of said cut blank, the thickness of the template being reduced by said compression by an amount at least as great as the total thickness of the blank;

iii) substantially releasing the suction hold-down of the cutting surface and applying suction through said exposed holes to pull the second portion of said cut blank on the cutting surface towards the suction lifting plate while the first portion of said cut blank is pressed against the cutting surface by the template, said resilient compression reducing the thickness of the template whereby the second portion of said cut blank is brought into closer proximity with said exposed holes and said applied suction;

iv) using said applied suction through said exposed holes to continue said pull of the second portion of said cut blank whereby the second portion of said cut blank is pulled against the suction lifting plate, while using said resilient compression of the template to continue to press the template against the first portion of said cut blank, whereby the first portion of said cut blank remains held in place on the cutting surface by the resilient compression of the template;

v) using the robotic actuation system to move the first suction lifting head away from the cutting surface, thereby separating said second portion of said cut blank from said first portion of said cut blank, wherein the first portion of said blank is pressed against said cutting surface by the compression of the template until after the second portion of the blank has fully separated from the first portion of said cut blank; and vi) using the robotic actuation system to move the first suction lifting head to deposit the second portion of said cut blank at a first location.

9. An automated sheet material cutting and handling system for producing sheet material articles, each of said articles having a planar shape formed by at least one cut made through a planiform blank, said system comprising:

a cutting surface provided with a suction hold-down for securing planiform articles to said surface during cutting of said articles by a cutting device;

a suction lifting apparatus, the suction lifting apparatus comprising at least one suction lifting head, said suction lifting head providing, in use, a first suction lifting portion, said first suction lifting portion comprising a substantially planar suction lifting plate for applying suction through a plurality of downwardly oriented holes in the suction lifting plate;

a resiliently compressible template cmprising a polymeric foamed material substrate, the substrate having an uncompressed thickness of more than a thickness of said planiform blank and said material being a formed or open cell material adapted to compress under pressure to a reduced volume and then spring back to its original volume when the pressure is released, the template being adhered by an adhesive to the suction lifting plate whereby the template covers over the holes in the suction lifting plate across a first portion of the suction lifting plate while leaving exposed the holes in the suction lifting plate across a second portion of the suction lifting plate, whereby the template is configured to block suction through said covered holes while leaving unobstructed suction through said exposed holes;

a robotic actuation system for moving the suction lifting apparatus;

a control system for controlling the operation of the robotic actuation system, the cutting device, the suction hold-down and the suction lifting apparatus, wherein the control system is configured to:

a) use the suction hold-down to secure the planiform blank on the cutting surface, and with said blank held in place on the cutting surface by the suction hold-down:

operate the cutting device to make said at least one cut through said planiform blank, said cut separating a first portion of said cut blank from a second portion of said cut blank, the template having a template shape that substantially corresponds with a shape or outline of the first portion of said cut blank; and use the robotic actuation system to move the suction lifting head to place the suction lifting plate over said cut blank with the template shape being in registration with said shape or outline of the first portion of said cut blank and to bring the template into contact with the first portion of said cut blank to resiliently compress the template against the first portion of said cut blank with said exposed holes located opposite the second portion of said cut blank;

b) substantially release the suction hold-down of the cutting surface and apply suction through said exposed holes to pull the second portion of said cut blank on the cutting surface towards the suction lifting plate and use the robotic actuation system to press the template against the first portion of said cut blank whereby the first portion of said cut blank is pressed against the cutting surface, said resilient compression reducing the thickness of the template whereby the second portion of said cut blank is brought into closer proximity with said exposed holes and said applied suction;

c) apply suction through said exposed holes to continue said pull of the second portion of said cut blank whereby the second portion of said cut blank is pulled against the suction lifting plate, while using said resilient compression of the template to continue to press the template against the first portion of said cut blank, whereby the first portion of said cut blank remains held in place on the cutting surface by the resilient compression of the template;

d) use the robotic actuation system to move the first suction lifting head away from the cutting surface, thereby separating said second portion of said cut blank from said first portion of said cut blank; and e) use the robotic actuation system to move the first suction lifting head to deposit the second portion of said cut blank at a first location.

10. The automated sheet material cutting and handling system as claimed in claim 9, in which said resilient compressibility of the substrate is provided by an air-permeable open-cell elastomeric material, and the substrate is adhered to the suction lifting surface by an adhesive layer that extends over said covered holes to restrict or prevent suction flow through said covered holes and said air-permeable open-cell elastomeric material of the substrate.

11. The automated sheet material cutting and handling system as claimed in claim 9, in which the adhesive is an adhesive layer, said layer extending over said covered holes to restrict or prevent suction flow through said covered holes.

12. The automated sheet material cutting and handling system as claimed in claim 9, in which the substrate has an uncompressed thickness that is at least 50% more than the thickness of said planiform blank.

13. The automated sheet material cutting and handling system as claimed in claim 9, in which the substrate has an uncompressed thickness that is at least double the thickness of said planiform blank.

14. The automated sheet material cutting and handling system as claimed in claim 9, in which the substrate has an uncompressed thickness that is no more than four times the thickness of said planiform blank.

15. The automated sheet material cutting and handling system as claimed in claim 9, in which the system further comprises a planiform blank on the cutting surface.

16. An automated sheet material cutting and handling system for producing sheet material articles, each of said articles having a planar shape formed by at least one cut made through a planiform blank, said system comprising:

a cutting surface provided with a suction hold-down for securing planiform articles to said surface during cutting of said articles by a cutting device;

a planiform blank on the cutting surface;

a suction lifting apparatus, the suction lifting apparatus comprising at least one suction lifting head, said suction lifting head providing, in use, a first suction lifting portion, said first suction lifting portion comprising a substantially planar suction lifting plate for applying suction through a plurality of downwardly oriented holes in the suction lifting plate;

a resiliently compressible template, the template being adhered by an adhesive to the suction lifting plate whereby the template covers over the holes in the suction lifting plate across a first portion of the suction lifting plate while leaving exposed the holes in the suction lifting plate across a second portion of the suction lifting plate, whereby the template is configured to block suction through said covered holes while leaving unobstructed suction through said exposed holes;

a robotic actuation system for moving the suction lifting apparatus;

a control system for controlling the operation of the robotic actuation system, the cutting device, the suction hold-down and the suction lifting apparatus, wherein the control system is configured to:

a) use the suction hold-down to secure the planiform blank on the cutting surface, and with said blank held in place on the cutting surface by the suction hold-down:

operate the cutting device to make said at least one cut through said planiform blank, said cut separating a first portion of said cut blank from a second portion of said cut blank, the template having a template shape that substantially corresponds with a shape or outline of the first portion of said cut blank; and use the robotic actuation system to move the suction lifting head to place the suction lifting plate over said cut blank with the template shape being in registration with said shape or outline of the first portion of said cut blank and to bring the template into contact with the first portion of said cut blank to resiliently compress the template against the first portion of said cut blank with said exposed holes located opposite the second portion of said cut blank;

b) substantially release the suction hold-down of the cutting surface and apply suction through said exposed holes to pull the second portion of said cut blank on the cutting surface towards the suction lifting plate and use the robotic actuation system to press the template against the first portion of said cut blank whereby the first portion of said cut blank is pressed against the cutting surface, said resilient compression reducing the thickness of the template whereby the second portion of said cut blank is brought into closer proximity with said exposed holes and said applied suction;

c) apply suction through said exposed holes to continue said pull of the second portion of said cut blank whereby the second portion of said cut blank is pulled against the suction lifting plate, while using said resilient compression of the template to continue to press the template against the first portion of said cut blank, whereby the first portion of said cut blank remains held in place on the cutting surface by the resilient compression of the template;

d) use the robotic actuation system to move the first suction lifting head away from the cutting surface, thereby separating said second portion of said cut blank from said first portion of said cut blank; and e) use the robotic actuation system to move the first suction lifting head to deposit the second portion of said cut blank at a first location.

* * * * *